US005375835A

United States Patent [19]

Van Nimwegen et al.

[11] Patent Number: 5,375,835

[45] Date of Patent: Dec. 27, 1994

[54] TELESCOPING POLE PORTABLE BASKETBALL SYSTEM

[75] Inventors: Edward G. Van Nimwegen, North Ogden; Barry D. Mower, Layton; Robert Adams, Kaysville; Kelly Taylor, Layton, all of Utah

[73] Assignee: Lifetime Products, Inc., Clearfield, Utah

[21] Appl. No.: 191,339

[22] Filed: Feb. 3, 1994

Related U.S. Application Data

[63] Continuation-in-part of Ser. No. 100,054, Jul. 30, 1993, Pat. No. 5,354,049, which is a continuation-in-part of Ser. No. 013,611, Feb. 4, 1993, Pat. No. 5,248,140.

[51] Int. Cl.[5] ..... A63B 63/08

[52] U.S. Cl. ..... 273/1.5 R; 248/407; 248/519; 248/910

[58] Field of Search ..... 273/1.5 R; 248/407, 248/514, 519, 910

[56] References Cited

U.S. PATENT DOCUMENTS

| | | | |
|---|---|---|---|
| 1,924,811 | 8/1933 | Schulz | 273/1.5 |
| 2,379,572 | 7/1945 | Gibson | 273/1.5 R X |
| 2,457,908 | 1/1949 | Meyerhoefer | 285/163 |
| 2,500,720 | 3/1950 | Van Der Heem | 285/161 |
| 2,534,067 | 12/1950 | Rubin | 273/1.5 |
| 3,017,183 | 1/1962 | Chalcroft | 273/1.5 |
| 3,025,058 | 3/1962 | Brumfield | 273/1.5 |
| 3,094,303 | 6/1963 | Belger | 248/40 |
| 3,161,395 | 12/1964 | Carter | 248/354 |
| 3,341,197 | 9/1967 | Bottorff | 273/1.5 R |
| 3,376,068 | 4/1968 | Walkinshaw | 297/437 |
| 3,427,025 | 2/1969 | Procter | 273/1.5 |
| 3,469,870 | 9/1969 | Barkus | 287/58 |
| 3,697,103 | 10/1972 | Mostyn | 287/58 CT |
| 3,716,234 | 2/1973 | Lancellotti | 273/1.5 R |
| 3,802,702 | 4/1974 | Pulley | 273/1.5 R |
| 3,841,631 | 10/1974 | Dolan | 273/1.5 R |
| 3,880,392 | 4/1975 | Duganich | 248/324 |
| 4,061,367 | 12/1977 | Moebius | 285/382.2 |
| 4,145,044 | 3/1979 | Wilson et al. | 273/1.5 R |
| 4,330,101 | 5/1982 | Andersen | 284/284 |
| 4,465,277 | 8/1984 | Dittrich | 273/1.5 A |
| 4,684,129 | 8/1987 | Anderson et al. | 273/1.5 R |
| 4,747,597 | 5/1988 | Kluczny | 273/1.5 R |
| 4,793,611 | 12/1988 | Thornell | 273/1.5 R |
| 4,805,904 | 2/1989 | Nye | 273/1.5 R |
| 4,869,501 | 9/1989 | Anastasakis | 273/1.5 R |
| 5,082,261 | 1/1992 | Pelfrey | 273/1.5 R |
| 5,098,092 | 3/1992 | Aakre et al. | 273/1.5 R |
| 5,158,281 | 10/1992 | Williams | 273/1.5 R |
| 5,248,140 | 9/1993 | Matherne et al. | 273/1.5 R |
| 5,259,612 | 11/1993 | Matherne et al. | 273/1.5 R |

*Primary Examiner*—William H. Grieb
*Attorney, Agent, or Firm*—Madson & Metcalf

[57] ABSTRACT

A basketball assemblage capable of assembly into a basketball system includes an inner pole section and an outer pole section which mate in a telescoping manner. The inner pole section contains a plurality of depressions which are releasably engageable by a latch secured to the outer pole section, thereby making the pole movable among a plurality of predetermined positions. The latch includes a pivot arm pivotally mounted for movement between a position engaging a selected depression to prevent telescoping pole movement, and a releasing position which allows movement. A safety lock pin is releasably engageable to prevent movement of the pivot arm. A slider positioned adjacent the inner pole section reduces binding. The pole also includes a sealed chamber for damping movement of the inner pole section to prevent the backboard from moving suddenly downward when the latch is released. The pole is prolate in cross-section, thereby reducing the total material required as compared to a circular pole, while still providing adequate structural strength. In an embodiment for forming a portable basketball system, the assemblage includes a hollow ballast-receiving base for connection to the pole via braces. The portable system assemblage is capable of disposition within an outer relatively flat container in a manner that impedes shifting movement of the pole sections within the container during shipping.

42 Claims, 9 Drawing Sheets

TELESCOPING POLE PORTABLE BASKETBALL SYSTEM

RELATED U.S. APPLICATIONS

This application is a continuation in part of application Ser. No. 08/100,054, filed Jul. 30, 1993, now U.S. Pat. No. 5,354,049, issued Oct. 11, 1994, and entitled APPARATUS AND METHOD FOR PACKAGING A PORTABLE BASKETBALL SYSTEM, which is a continuation in part of application Ser. No. 08/013,611, filed Feb. 4, 1993, now issued as U.S. Pat. No. 5,248,140 and entitled APPARATUS AND METHOD FOR PACKAGING A BASKETBALL GOAL SYSTEM WITH WEIGHT-FILLABLE BASE. The foregoing application and patent are incorporated herein by reference.

FIELD OF THE INVENTION

The present invention relates to a portable basketball system, and more particularly to a portable basketball system including an adjustable telescoping pole which may be latched at different lengths for placing a basketball goal and backboard at different predetermined heights, and which also includes an air-cushion mechanism for cushioning movement of the basketball goal and backboard when the telescoping pole is shortened.

TECHNICAL BACKGROUND OF THE INVENTION

As the game of basketball has increased in popularity, a greater number of people have purchased basketball systems for use at their homes. Such basketball systems typically include at least a pole to which a backboard and a goal are secured so that the goal is suspended above a playing surface. Although some basketball systems are permanently mounted into the ground near the home, or to the home itself, portable basketball systems are increasingly used. The advantages of portable basketball systems relative to permanently installed systems in general, and the relative merits of different portable basketball systems in particular, are detailed in application Ser. No. 08/100,054, and U.S. Pat. No. 5,248,140, which are incorporated herein by reference.

In either a portable or a permanently installed basketball system, it may be desirable to adjust the height of the goal above the playing surface. For instance, the basketball system may be used by relatively tall players for some games and by shorter players during other games. The basketball system may be used at different times by players of different strengths or skill levels. Or the basketball system may be used for regulation play at one time and for "dunking practice" at another time.

One approach to facilitating height adjustment of basketball goals involves clamping the backboard to the pole with one or more U-shaped bolts which are drawn against the pole by nuts threaded onto the ends of the bolts. By loosening the nuts, sliding the backboard along the pole, and re-tightening the nuts, one may alter the height of the goal.

However, bolting the backboard to the pole with U-bolts has several disadvantages when the time comes to adjust the goal's height. A wrench of the proper size is required to loosen and tighten the nuts. The bolt threads may be damaged or destroyed, and may be exposed to deterioration in outdoor systems from weathering. The bolts sliding along the pole tend to scratch the surface of the pole, marring its appearance and increasing its vulnerability to rust. Once the nuts are loosened, the backboard may slip suddenly downward under its own weight, injuring the user or damaging the basketball system. It may also be difficult to prevent the backboard from sliding down past the desired height. Thus, two or more people may be required: one to loosen and tighten the nuts, and a second to hold the backboard in the desired position.

Another approach to basketball goal height adjustment includes positioning a set bolt in a threaded hole in an outer length of pole, and positioning an inner length of pole telescopically within the outer length of pole. When the set bolt is tightened, the end of the set bolt presses against the outer surface of the inner length of pole.

The set bolt approach has many of the same disadvantages as the U-bolt approach just described. The threads on the set bolt may be damaged. The goal and backboard may slip suddenly when the set bolt is loosened. Or the set bolt may scratch the inner length of pole, particularly where the end of the set bolt is forced against the inner length of pole to hold the goal at a particular height.

A somewhat similar approach includes positioning one or more retaining pins through holes placed in both the inner and outer lengths of a telescoping pole. Because the pin goes through the inner pole length rather than resting against the outside surface of the inner pole, the risk of marring the inner pole is greatly reduced. However, the backboard may still slip suddenly when the retaining pin is removed. Moreover, once it is removed, the retaining pin is a loose piece which may easily be lost.

Another method for adjusting the height of a telescoping pole is disclosed in U.S. Pat. No. 5,098,092 issued to Aakre et al. A threaded extension shaft is connected via gears to a crankshaft having a handle. Rotation of the handle turns the gears, which turn the threaded extension shaft, thereby extending or retracting a portion of the basketball pole. A principal drawback of this approach is the weight of the extension shaft, gears, and related hardware. Lightweight portable basketball systems are preferable because they are more convenient and less expensive to ship, to position after assembly, and to store than heavier systems.

Yet another approach to facilitating height adjustment is to position a parallelogram-shaped structure between the backboard and the pole. Such an approach is disclosed in U.S. Pat. No. 4,805,904 issued to Nye. Use of the parallelogram structure is preferable to the U-bolt and set bolt approaches described above, because there are no threads to damage and little risk of marring the pole finish. There are no loose retaining pins to be lost. Moreover, the backboard is also constrained to prevent sudden large movements that may injure a user or damage the basketball system. However, the parallelogram structure contains several moving parts that may fail, and it includes several braces which add to the manufacturing cost, weight, and complexity of the basketball system.

Thus, it would be an advancement in the art to provide a height-adjustable basketball system wherein there is little risk that the backboard and goal will slip suddenly downward while the height of the goal above the playing surface is being adjusted.

It would be a further advancement in the art to provide such a basketball system wherein the height adjustment mechanism does not add substantially to the weight of the system.

It would also be an advancement in the art to provide such a basketball system which does not require the use of a wrench or other additional tool for height adjustment.

It would be a related advancement to provide such a basketball system which does not involve threads exposed to potential damage or rust.

Such a height-adjustable basketball system is disclosed and claimed herein.

BRIEF SUMMARY OF THE INVENTION

The present invention provides a basketball assemblage capable of assembly into a basketball system. The basketball assemblage comprises a plurality of pole sections, including at least an inner pole section and an outer pole section which mate in a telescoping manner. The pole sections may be assembled to form a pole having a base end and a backboard end. Depending on the embodiment of the invention, a backboard and a basketball goal are either included in the basketball assemblage or supplied separately by the user who assembles the assemblage into a basketball system.

The inner pole section preferably has an exterior surface containing a plurality of depressions. A latch secured to the outer pole section is configured to releasably engage the depressions. Thus, the pole is movable among a plurality of predetermined positions by telescoping movement of the inner pole section within the outer pole section, and the pole may be fixed at a predetermined length by engagement of a selected depression by the latch.

In a preferred embodiment, the latch includes a bracket mounted to the outer pole section, a pivot arm with an engagement edge, and a spring. The pivot arm is pivotally mounted to the bracket for movement between an engaging position in which the engagement edge is positioned for engaging a selected one of the depressions for preventing telescoping movement of the inner pole section toward the base end of the pole, and a releasing position in which the engagement edge is positioned free of the depressions for allowing telescoping movement of the inner pole section toward the base end. The spring or another biasing means is preferably positioned to urge the pivot arm toward the engaging position. The latch preferably also includes a safety lock pin which is releasably engageable with the bracket at a location adjacent the pivot arm. When engaged, the safety lock pin prevents movement of the pivot arm from the engaging position into the releasing position, thereby locking the pole at a fixed length. A conventional padlock may be used in place of the pin.

It is presently preferred that the basketball assemblage also include a slider positioned at one end of the outer pole section adjacent the inner pole section. The inner pole travels against the slider rather than against the outer pole section. The slider reduces binding during telescoping movement of the inner pole section within the outer pole section. The slider also assists in preventing marring of the inner pole section's exterior surface. In addition, the slider is preferably resilient enough to minimize the impact of aberrations in the inner pole section, so manufacturing tolerances may be greater with the slider than without it. The coefficient of friction between the inner pole section and the slider is preferably less than the coefficient of friction between the inner pole section and the outer pole section.

In one embodiment, the pole also includes a base seal disposed for substantially sealing the base end of the pole, and a traveling seal secured to the inner pole section. The traveling seal is positioned between the inner pole section and the outer pole section. Movement of the inner pole section toward the base end of the pole is damped by compressing air within the pole between the traveling seal and the base seal. Damping prevents sudden downward movement of the backboard and goal when the latch is released.

This embodiment also preferably includes a valve, such as a check ball valve. The valve is configured to release air slowly from within the pole in response to movement of the traveling seal toward the base seal, so the backboard and goal move slowly down (toward the playing surface). The valve also permits air to enter the pole in response to movement of the traveling seal away from the base seal. This permits the pole to extend, thereby raising the backboard and goal further above the playing surface.

The pole may be circular in cross-section. However, it is presently preferred that the cross-sectional shape of the pole be a shape which reduces the total material required when compared to a circular pole, while still providing adequate structural strength. For instance, one preferred pole is prolate in cross-section, with two flat sides and two curved ends. Depressions for engaging the latch are formed in one of the flat sides.

In an embodiment for forming a portable basketball system, the assemblage includes a hollow ballast-receiving base which may be assembled with the pole, the backboard, and the goal. In the assembled portable basketball system, the base supports the pole in a stationary, substantially upward position. The base is connected to the pole near the base end of the pole. The goal is connected to the backboard, which is connected to the pole near the backboard end of the pole so that the goal is suspended at an elevation above the base. The base rests on the floor, driveway, or other playing surface.

The pole and base are preferably connected by a brace having a pole end and a base end. The brace connects the base end of the pole to the base. The base, pole, brace, backboard, and goal are capable of assembly to form a portable basketball system wherein the brace is disposed on the opposite side of the pole from the goal, thereby reducing the risk of a player accidentally encountering the brace during basketball play.

The basketball assemblage is preferably capable of disposition for packaging and shipping within an outer relatively flat container. In this embodiment, the base preferably has an exterior contour for receiving and retaining the pole sections within the container and impeding shifting movement of the pole sections within the container during shipping. The exterior contour of the base includes at least one notch for receiving and retaining at least one of the pole sections within the container.

These and other features and advantages of the present invention will become more fully apparent through the following description and appended claims taken in conjunction with the accompanying drawings.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only provide a selected embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
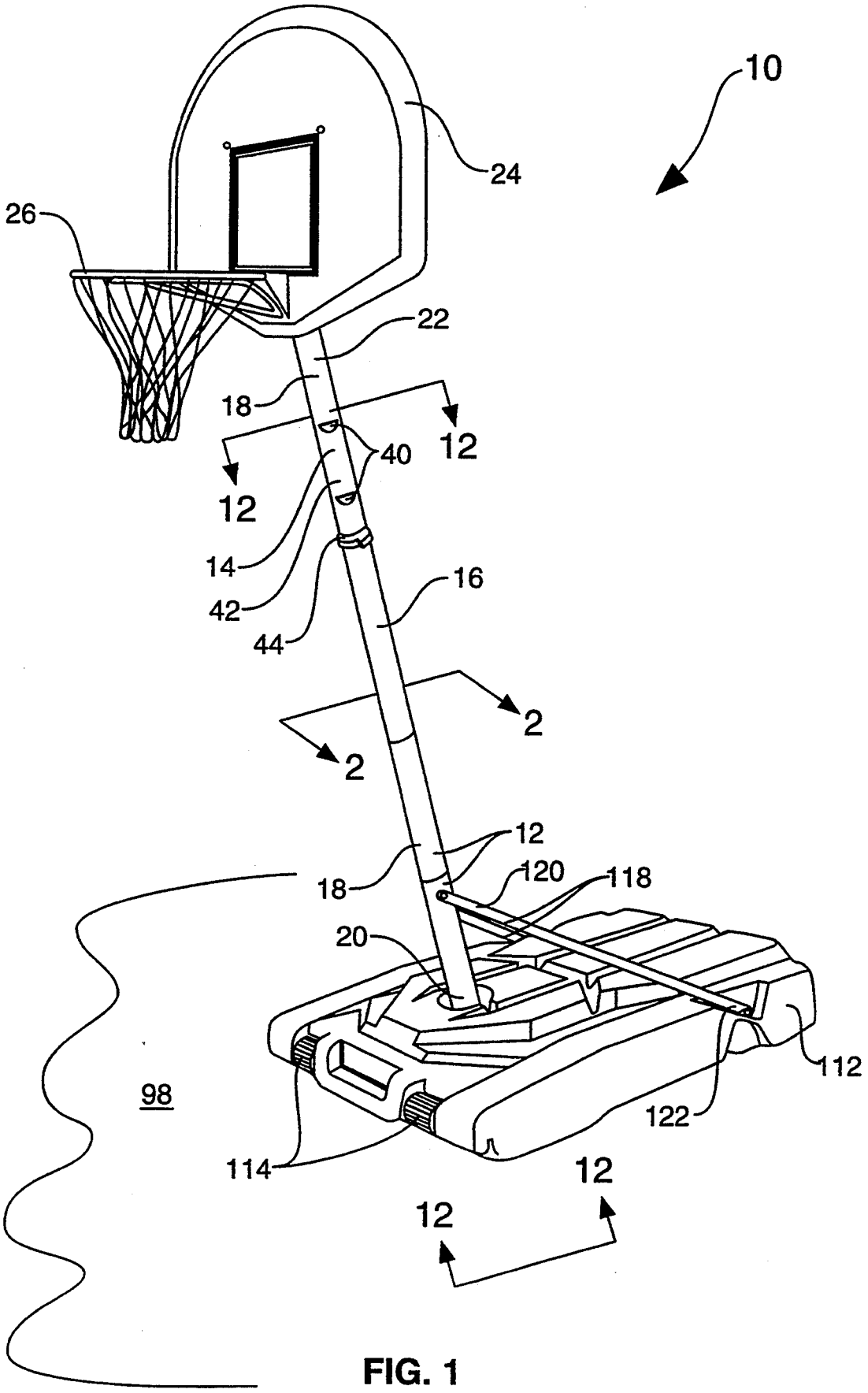
FIG. 1 is a perspective view of an assembled embodiment of the present invention showing a portable basket system, including a pole, a latch, and a base.

Reference is now made to the figures wherein like parts are referred to by like numerals. The present invention relates to a basketball assemblage capable of assembly into a basketball system. A presently preferred assembled portable basketball system is indicated generally at 10 in FIG. 1. The basketball assemblage 10 comprises a plurality of pole sections 12, including at least an inner pole section 14 and an outer pole section 16 which mate in a telescoping manner. The pole sections are assembled to form a pole 18 having a base end 20 and a backboard end 22.

In the embodiment shown, a backboard 24 and a basketball goal 26 are included in the basketball assemblage 10. In other embodiments, a backboard 24 and a goal 26 are supplied separately by the user who assembles the assemblage into a basketball system according to the teachings of the present invention. For instance, the backboard 24 may be a conventional forty inch shatterproof plastic or fiberglass backboard, and the goal 26 may be a conventional metal goal.

Figure 2:
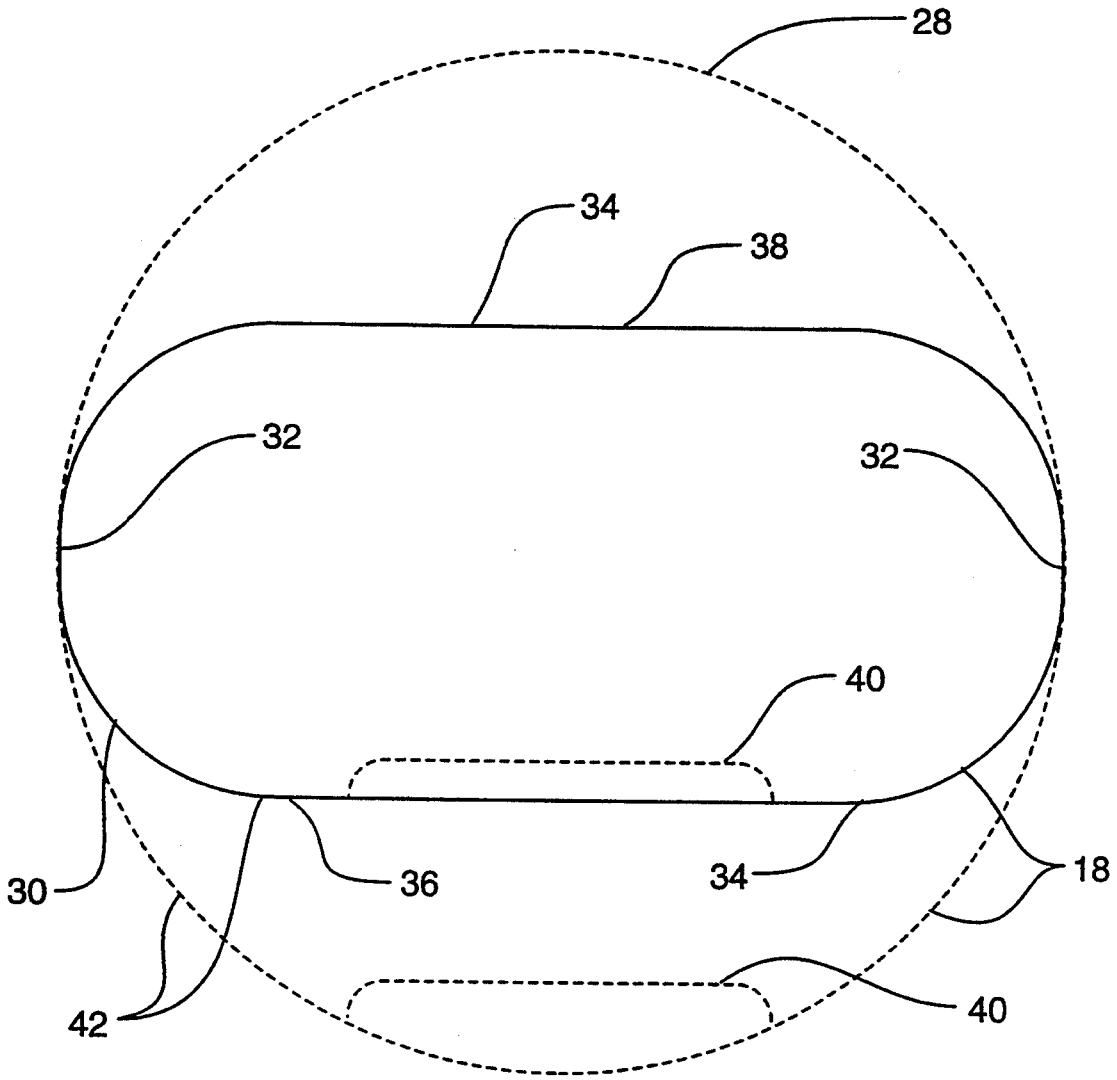
FIG. 2 is a cross-sectional view of a basketball system pole taken along the line 2—2 in FIG. 1.

As illustrated by phantom lines in FIG. 2, one embodiment of the pole 18 has a circular cross-section 28. However, a prolate cross-section 30 is presently preferred. The prolate cross-section 30 includes two equally sized semi-circles 32 connected by two equally sized and parallel line segments 34. The parallel line segments 34 define two flat sides 36, 38 of the pole 18. One flat side 36 of the pole 18 contains depressions 40, whose purpose is explained below. Advantageously, a pole 18 with a prolate cross-section 30 requires approximately thirty percent less material than a pole 18 with a corresponding circular cross-section 28. Nonetheless, the prolate pole 18 still provides adequate structural strength if it is oriented for use with the two flat sides 36, 38 substantially perpendicular to the backboard (24 in FIG. 1). It will be appreciated that other cross-sectional shapes may also be employed for the pole 18 according to the teachings of the present invention, such as rectangles, squares, or a D-shape, so long as they stop the pole sections 12 from twisting relative to each other and provide adequate structural strength.

Figure 3:
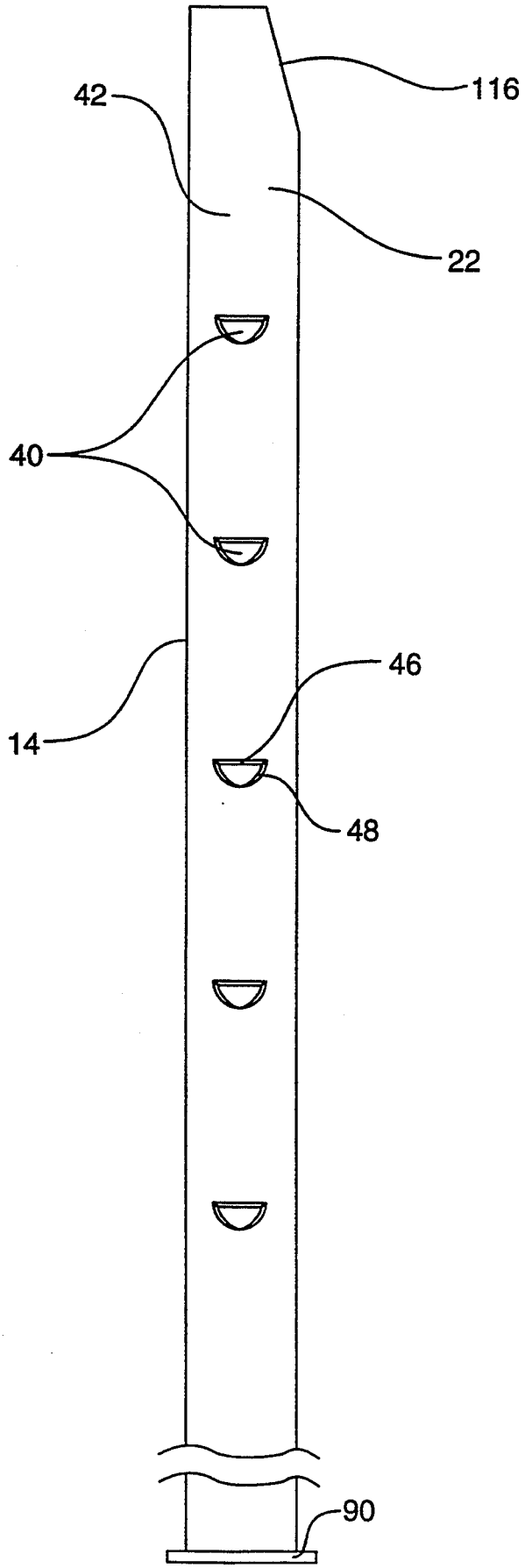
FIG. 3 is a side plan view of a portion of the pole shown in FIG. 1, illustrating an inner pole section having a plurality of depressions.

As illustrated in FIG. 1, the inner pole section 14 has an exterior surface 42 containing a plurality of depressions 40. A latch 44 secured to the outer pole section 16 is configured to releasably engage the depressions 40. The depressions 40 are further illustrated in FIGS. 3 through 6. As shown in FIG. 3, the depressions 40 are generally the shape of a flat edge 46 located above a semicircle 48. As used herein, a first element is "above" a second element if the first element is further away from the playing surface 98 when the assemblage 10 is assembled for use as shown in FIG. 1. This denotation is for convenience only, and in no way limits the scope of the present invention when the assemblage 10 is not so assembled.

Figure 4:
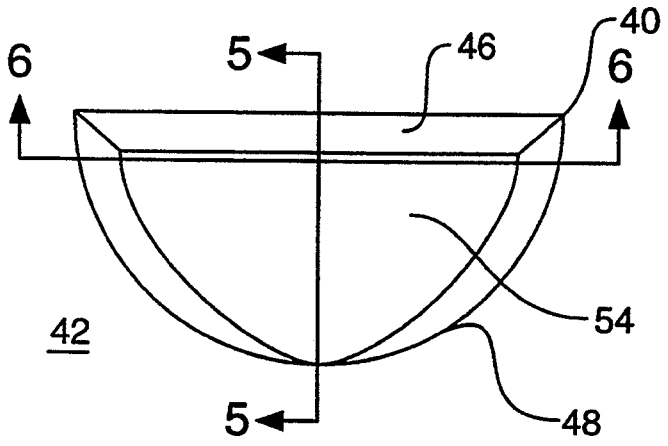
FIG. 4 is an enlarged view of one of the depressions shown in FIG. 3.
Figure 5:
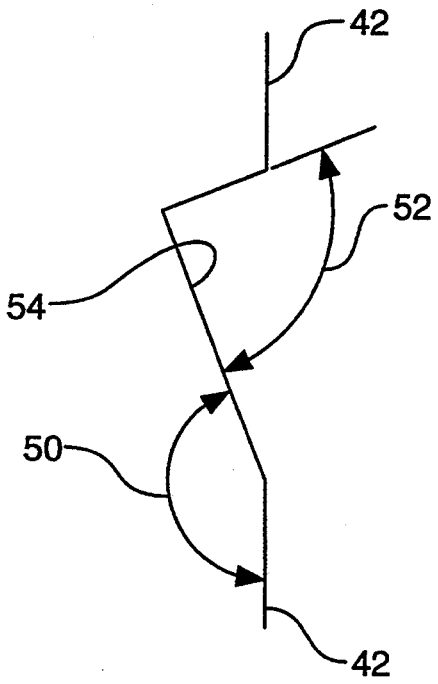
FIG. 5 is a cross-sectional view of a depression taken along line 5—5 in FIG. 4.
Figure 6:
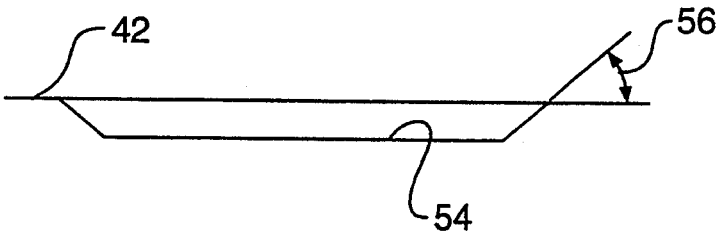
FIG. 6 is a cross-sectional view of a depression taken along line 6—6 in FIG. 4.

A single depression 40 is shown in greater detail in FIGS. 4 through 6. With particular reference to FIG. 5, the angle indicated at 50 is in the range from about one hundred and sixty to about one hundred and seventy degrees, and is preferably about one hundred and sixty-five degrees. The angle indicated at 52 is in the range from about eighty-five to about ninety-five degrees, and is preferably about ninety degrees. The depressions 40 are preferably formed by pressing rather than punching, so no hole is formed in the exterior surface 42. Instead, a depressed portion 54 of the exterior surface 42 is pressed inward. The inner pole section 14 is preferably hollow so as to minimize the assemblage's weight. With respect to FIG. 6, the angle indicated at 56 is in the range from about fifty-five to about sixty-five degrees, and is preferably about sixty degrees.

It will be appreciated that the angles and shape of the depressions 40 may be varied according to the teachings herein, so long as the depressions permit the inner pole section (14 in FIG. 1) to move upward without engaging the latch (44 in FIG. 1) and also securely engage the latch if the inner pole section moves downward far enough to bring a depression adjacent the latch. If the angle indicated at 52 is too large, the friction of the exterior surface 42 against the engagement edge (64 in FIG. 12) will be insufficient and the latch (44 in FIG. 12) with not properly remain in the engaging position. If the angle indicated at 52 is too small, too much of the load from the backboard (24 in FIG. 1) will be transmitted to the latch (44 in FIG. 1) and thence to the outer pole section (16 in FIG. 1), possibly resulting in damage to the latch or the outer pole section.

Figure 7:
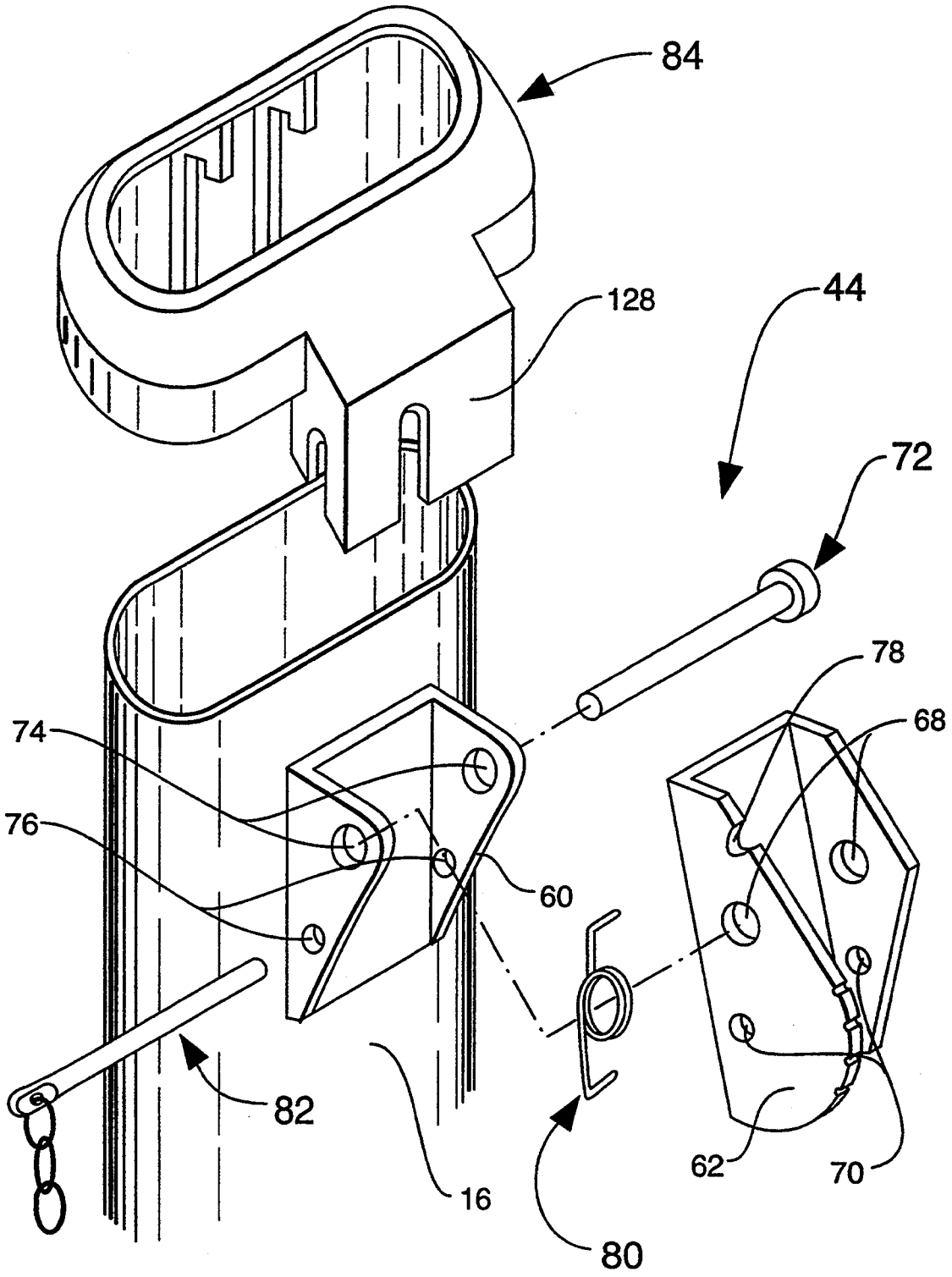
FIG. 7 is an exploded perspective view of the latch shown in FIG. 1, including a pivot arm.
Figure 11:
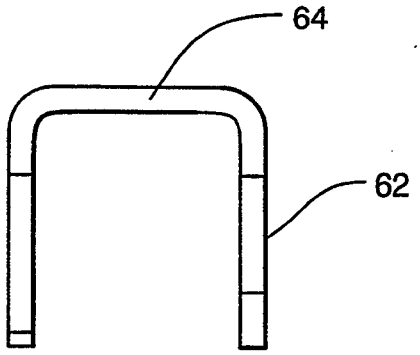
FIGS. 8 through 11 are left side, right side, front, and top plan views, respectively, of the pivot arm shown in FIG. 7.
Figure 8:
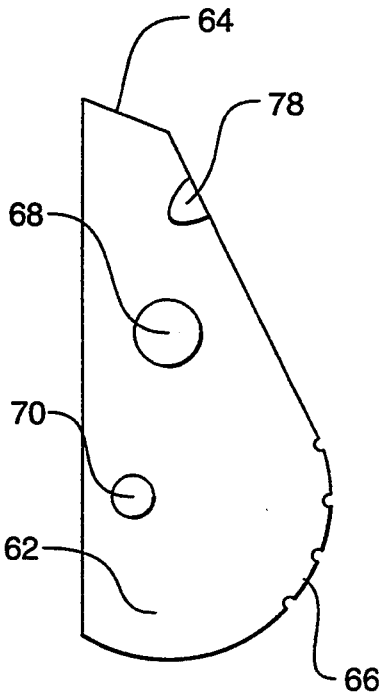
Figure 10:
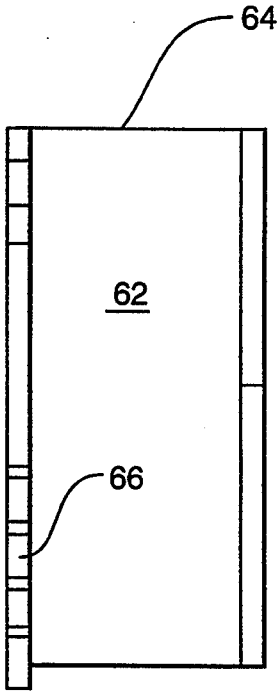
Figure 9:
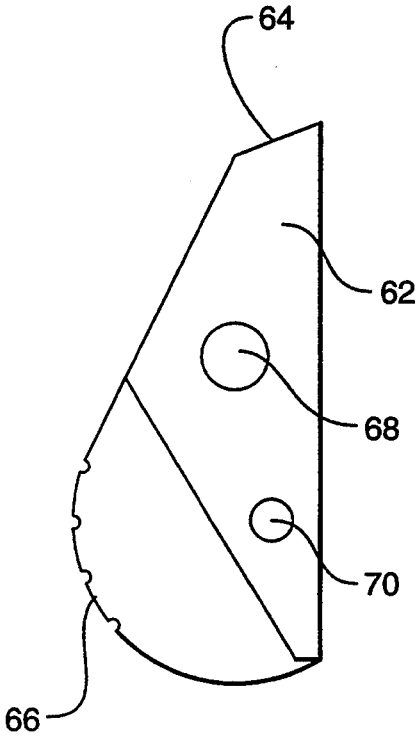

A preferred embodiment of the latch 44 is illustrated in FIG. 7. The latch 44 includes a bracket 60 mounted to the outer pole section 16. The bracket 60 is preferably mounted by spot-welding, but riveting or other conventional methods may also be used. The bracket includes a pair of aligned pivot holes 74 and a pair of aligned safety holes 76. The latch also includes a pivot arm 62 with an engagement edge 64. As shown in greater detail in FIGS. 8 through 11, the pivot arm 62 has a ribbed surface 66, a pair of aligned pivot holes 68, a pair of aligned safety holes 70, and a spring notch 78.

With reference once more to FIG. 7, the pivot arm 62 is pivotally mounted to the bracket 60 by a pivot pin 72.

The pivot pin 72 fits through the pivot holes 68 of the pivot arm 62 and through the pivot holes 74 of the bracket 60. A spring 80 is positioned with one end against the bracket 60 and another end in a spring notch 78 in the pivot arm 62. A safety lock pin 82 is releasably engageable with the bracket 60 and the pivot arm 62 through safety holes 76, 70, respectively.

Thus assembled, the pivot arm 62 is capable of movement between an engaging position in which the engagement edge 64 is positioned for engaging a selected one of the depressions 40, and a releasing position in which the engagement edge 64 is positioned free of the depressions 40. The engaging position of the pivot arm 62 is shown in solid lines in FIG. 12, while the releasing position of the pivot arm 62 is shown in phantom lines in that Figure. The spring 80 is configured to urge the pivot arm 62 toward the engaging position.

Figure 12:
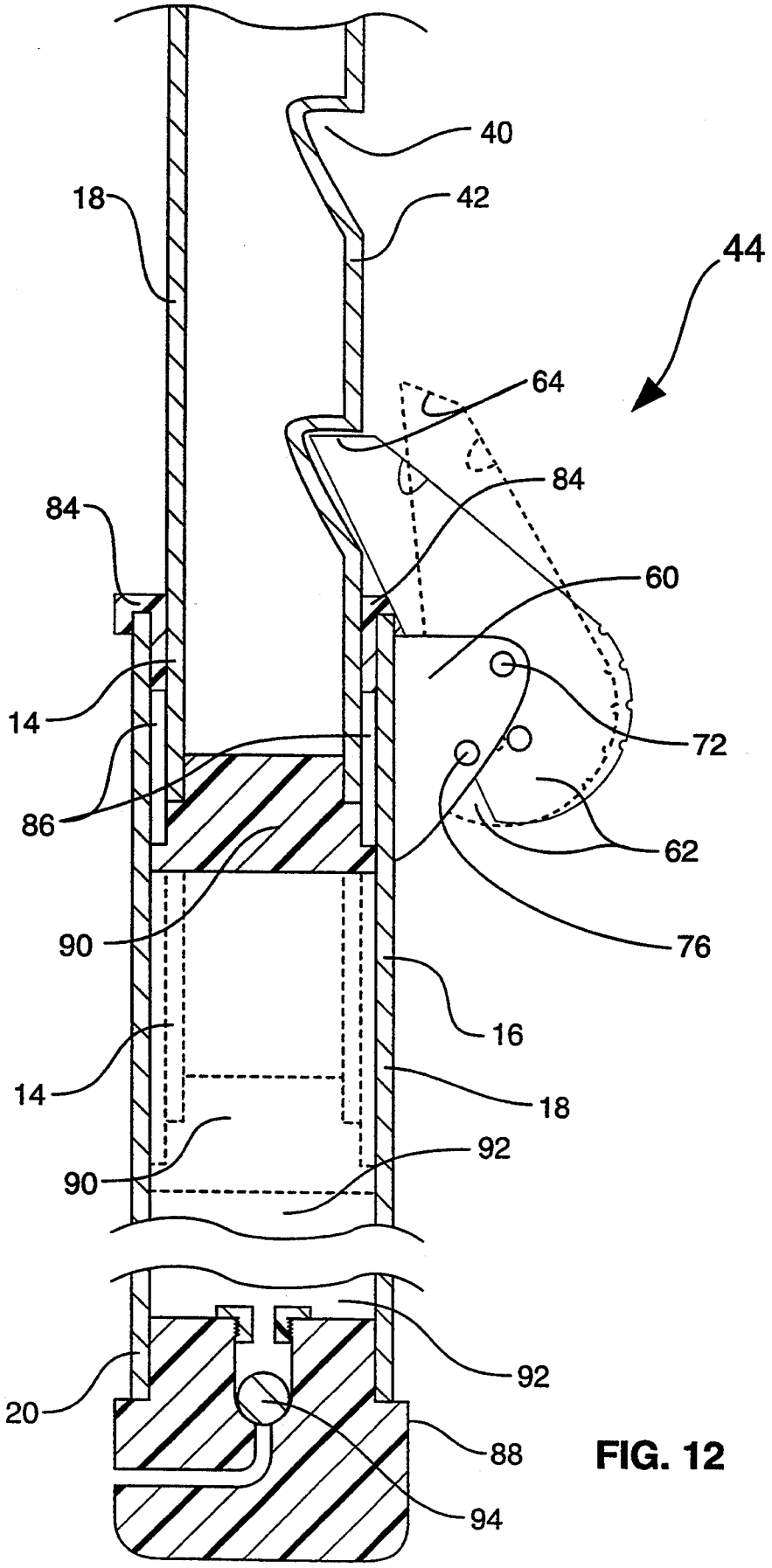
FIG. 12 is a cross-sectional view taken along line 12—12 in FIG. 1, further illustrating the pole and latch.

As shown best in FIG. 12, the pole 18 is movable among a plurality of predetermined positions by telescoping movement of the inner pole section 14 within the outer pole section 16. The pole 18 may be fixed at a predetermined length by engagement of a selected depression 40 by the engagement edge 62 of the latch 44. The safety lock pin 82 or a conventional padlock (not shown) may be engaged in the holes 76 to prevent movement of the pivot arm 62 from the engaging position into the releasing position, thereby locking the pole 18 at a fixed length.

With reference to FIGS. 7 and 12, it is presently preferred that the basketball assemblage (10 in FIG. 1) also include a slider 84 positioned at one end of the outer pole section 16 adjacent the inner pole section 14. The inner pole section 14 rests and slides against the slider 84 rather than the outer pole section 16, as the slider 84 crosses a gap 86 between the pole sections 14, 16. The slider 84, which is the load-bearing component, reduces friction during telescoping movement of the inner pole section 14 within the outer pole section 16. The slider also damps vibrations of the pole sections 14, 16 during such telescoping movement. The slider 84 is preferably integral with a latch cap 128 as shown best in FIG. 7.

With reference to FIG. 12, the slider 84 comprises a material selected such that the coefficient of friction between the inner pole section 14 and the slider 84 is less than the coefficient of friction between the inner pole section 14 and the outer pole section 16. For instance, the slider 84 may comprise plastic, nylon, polyolefin, low-density polyethylene, or a synthetic resin such as that sold under the mark DELRIN by E. I. Du Pont de Nemours and Co., or that sold under the mark ERTALYTE by Erta, N.V., of Belgium.

In a presently preferred embodiment shown in FIG. 12, the pole 18 also includes a base seal 88 disposed for substantially sealing the base end 20 of the pole 18. A traveling seal 90 is secured to the inner pole section 14. The traveling seal 90 spans the gap 86 between the inner pole section 14 and the outer pole section 16. The traveling seal 90, the base seal 88, the outer pole section 16, and the remainder of the pole 18 between the traveling seal 90 and the base seal 88 thus define an air-filled chamber 92. The traveling seal 90 and the base seal 88 may be secured to the pole 18 by conventional means such as sheet metal screws. The base seal 88 may comprise high density polyethylene, ABS plastic, or similar conventional material that is light in weight and capable of forming a substantially airtight seal.

This embodiment also preferably includes a valve 94 disposed in the base seal 88. The valve 94 is configured to release air slowly from within the pole 18 in response to movement of the traveling seal 90 toward the base seal 88, so the backboard and goal (24 and 26, respectively, in FIG. 1) move slowly downward when the engagement edge 64 is in the releasing position (indicated by phantom lines). The valve 94 also permits air to enter the pole 18 in response to movement of the traveling seal 90 upward away from the base seal 88. The valve 94 thus permits the pole 18 to extend, raising the backboard and goal (24, 26 in FIG. 1) further above the playing surface (98 in FIG. 1).

Figure 13:
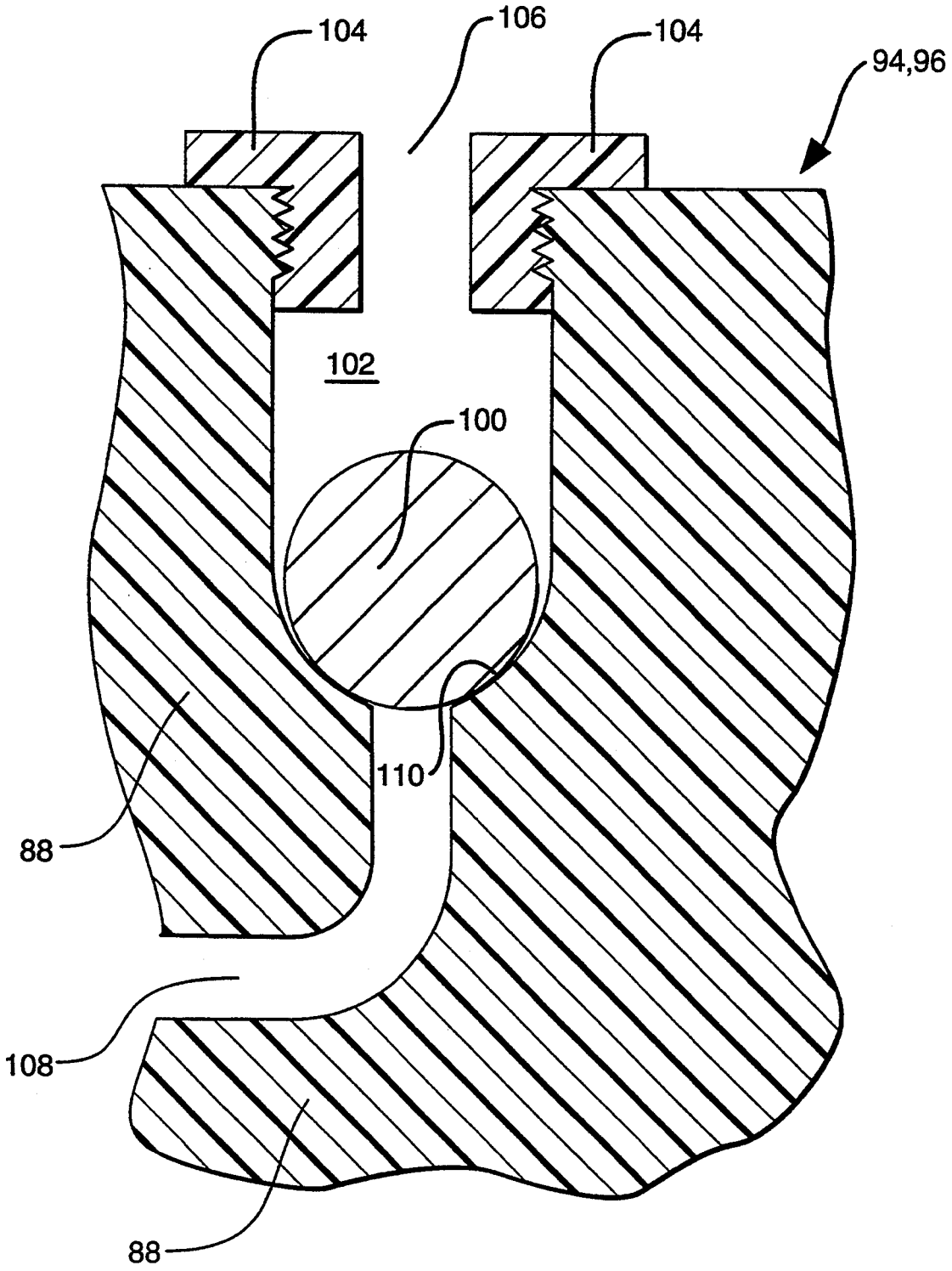
FIG. 13 is an enlarged view of a check ball valve shown in FIG. 12.

For example, the valve 94 may be a check ball valve 96 as illustrated in FIG. 13. The check ball valve 96 includes a ball bearing 100 situated in a chamber 102 in the base seal 88. The ball bearing 100 is trapped within the chamber 102 by a hemispherical seat 110 formed at one end of the chamber 102 and a ball valve cap 104 secured at the opposite end of the chamber 102. The chamber 102 is in fluid communication with the interior (92 in FIG. 12) of the pole (18 in FIG. 12) via an orifice 106 in the ball valve cap 104. The chamber 102 is also in fluid communication with the ambient air outside the pole via a channel 108. With reference once more to FIG. 12, it will be appreciated that the check ball valve 96, or a similar valve 94, may also be disposed within the traveling seal 90. Thus disposed, the valve 94, in combination with the other elements of the pole 18, preferably damps downward movement of the inner pole section 14 and permits upward motion of the inner pole section 14.

With regard to FIG. 1, an embodiment of the assemblage 10 for forming a portable basketball system includes a hollow ballast-receiving base 112 which may be assembled with the pole 18, the backboard 24, and the goal 26. Wheels 114 are secured to the base 112 to assist in moving the assembled portable basketball system. The base 112 supports the pole 18 in a stationary, substantially upward position.

In a presently preferred embodiment, the base seal (88 in FIG. 12) at the base end 20 of the pole 18 rests on the playing surface 98. The base 112 is connected to the pole 18 near the base end 20 of the pole 18 by a steel rod which passes through holes in the base 112 and through corresponding diametrically opposed holes in the pole 18. The goal 26 is connected to the backboard 24, which is connected to the pole 18 near the backboard end 22 of the pole 18. As shown best in FIG. 3, the backboard (24 in FIG. 1) rests against a bevel 116 on the end 22 of the pole 18. Backboard brackets (124 in FIG. 14) secure the pole 18 to the backboard 24.

With reference to FIG. 1, the pole 18 and the base 112 are preferably connected by two braces 118. Each brace 118 has a pole end 120 and a base end 122. Each brace 118 is connectable to the pole 18 at the pole end 120 of the brace 118, near the base end 20 of the pole 18. Each brace 118 is also connectable to the base 112 at the base end 122 of the brace 118.

It is presently preferred that the pole 18 meet the base 112 approximately at the center of the base 112, and that the braces 118 be configured to lean the pole 18 forward at an angle from the vertical of about ten to fifteen degrees, and most preferably at about eleven degrees. The bevel (116 in FIG. 3) on the backboard end 22 of the pole 18 is preferably at the same angle, so that the backboard 24 is substantially vertical.

It is also presently preferred that the base 112, the pole 18, the braces 118, the backboard 24, and the goal 26 be capable of assembly to form a portable basketball system wherein the braces 118 are disposed on the opposite side of the pole 18 from the goal 26. Thus disposed, the braces 118 are far less likely to be accidentally encountered by a player during basketball play. The braces 118 are also loaded in tension rather than compression. Thus, the braces 118 are much less likely to buckle when side-loaded, stepped on, or otherwise subjected to forces not aligned with their longitudinal axes. If a player hangs on the rim of the goal 26, for instance, the tension on the braces 118 merely increases. In contrast to the present invention, braces positioned on the same side of the pole 18 as the goal 26 are subject to buckling from the additional force imposed by a player hanging from the goal 26.

Figure 14:
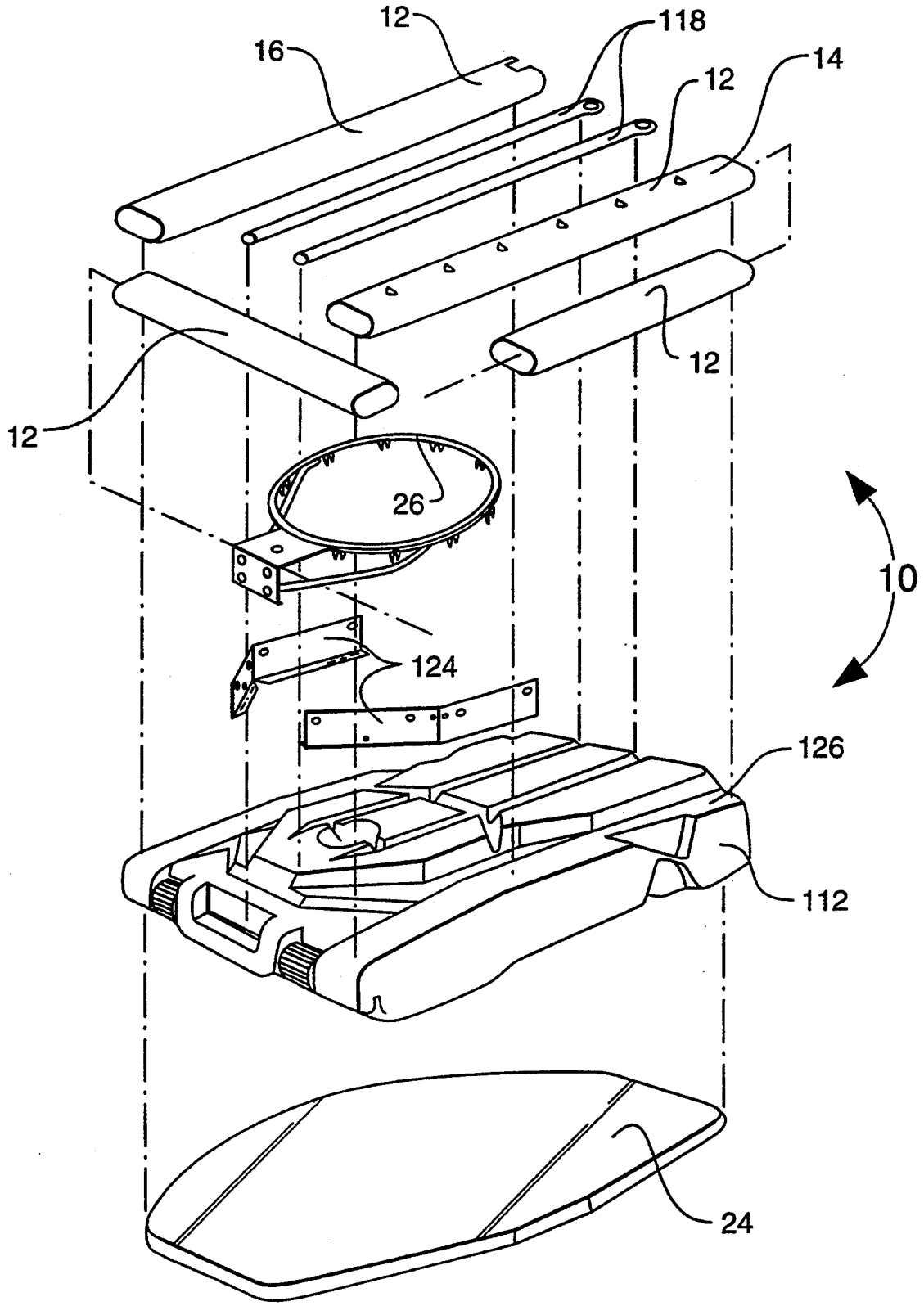
FIG. 14 is an exploded perspective view of the pole, base, and other components of the assemblage shown in FIG. 1, illustrating positioning of the assembly for packaging in a relatively flat container (not shown).

As illustrated in FIG. 14, the basketball assemblage 10 is preferably capable of disposition for packaging and shipping within an outer relatively flat container. As used herein, the phrase "relatively flat" when applied to a shipping carton means a carton having a depth of about 12 inches or less. Suitable containers are described in application Ser. No. 08/100,054, and U.S. Pat. No. 5,248,140, which descriptions are incorporated herein by reference. In this embodiment, the base 112 preferably has an exterior contour for receiving and retaining the pole sections 12 within the container and impeding shifting movement of the pole sections 12 within the container during shipping. The exterior contour of the base 112 includes at least one notch 126 for receiving and retaining at least one of the pole sections 12 within the container.

In operation, the present invention provides a height-adjustable basketball system, such as that illustrated in FIG. 1, wherein there is little risk that the backboard 24 and goal 26 will slip suddenly downward while the height of the goal 26 above the playing surface 98 is being adjusted. In a conventional system employing U-shaped brackets, a user does not know how loose the nut on the bracket must be before the backboard begins to slip downward. In the present invention, however, the backboard 24 does not begin to travel downward until the user removes the safety lock pin (82 in FIG. 7) from the bracket (60 in FIG. 7) and moves the engagement edge (64 in FIG. 12) of the latch (44 in FIG. 12) into the releasing position (shown in phantom in FIG. 12). Thus, the user precisely controls the time at which the descent of the backboard 24 begins.

Moreover, movement of the inner pole section 14 toward the base end 20 of the pole 18 is damped, so the backboard 24 does not slip suddenly downward but rather descends slowly. As shown best in FIG. 12, air is compressed within the pole chamber 92 between the traveling seal 90 and the base seal 88. The valve 94 permits the compressed air to escape from the chamber 92 at a rate slow enough to make the descent of the inner pole section 14 manageable by the user.

The height adjustment mechanism of the present invention also has several advantageous features. Unlike conventional systems which employ extension shafts or parallelogram-shaped structures, the mechanism of the present invention does not add substantially to the weight of the system. As illustrated in FIGS. 7 and 12, the latch 44 adds very little to the overall weight of the assemblage (10 in FIG. 1). The depressions 40 in the inner pole section 14, which the latch 44 engages, add nothing to the assemblage's weight. Indeed, a significant reduction in weight is obtained by making the pole 18 prolate, as illustrated in FIG. 2.

With reference to FIGS. 7 and 12, the height adjustment mechanism of the present invention does not require the use of a wrench or other additional tool. Finger pressure against the ribbed surface (66 in FIG. 8) of the pivot arm 62, possibly in combination with a slight upward movement of the inner pole section 14 to release pressure on the engagement edge 64, suffice to release the latch 44. The height adjustment mechanism of the present invention also does not involve threads exposed to potential damage or rust. The latch 44 need not include threads, and is covered by a protective latch cap 128 to protect the latch 44 against accidental impacts.

It will be appreciated that aspects of the present invention may be embodied in either portable or permanently installed basketball systems. For instance, the latch 44 and corresponding depressions 40 may be employed in either case, as may the prolate pole 18, and the damping mechanism which includes the travelling seal 90 and the base seal 88. These three aspects (latch, prolate pole, and damping mechanism) may also be employed alone or in various combinations with one another.

In short, the invention may be embodied in other specific forms without departing from its spirit or essential characteristics. The described embodiments are to be considered in all respects only as illustrative and not restrictive. Any explanations provided herein of the scientific principles employed in the present invention are illustrative only. The scope of the invention is, therefore, indicated by the appended claims rather than by the foregoing description. All changes which come within the meaning and range of equivalency of the claims are to be embraced within their scope.

What is claimed and desired to be secured by patent is:

1. A basketball assemblage capable of disposition for packaging and shipping within an outer relatively flat container and capable of assembly into a portable basketball system, the basketball assemblage comprising:

a backboard;

a goal connectable to said backboard;

a plurality of pole sections including at least an inner pole section and an outer pole section, said inner pole section having an exterior surface containing a plurality of depressions, said plurality of pole sections capable of assembly to form a pole having a base end and a backboard end;

a latch secured to said outer pole section and configured to releasably engage said depressions in said exterior surface of said inner pole section, said pole being movable among a plurality of predetermined positions by telescoping movement of said inner pole section within said outer pole section and said pole fixable at a predetermined length by engagement of a selected one of said depressions by said latch;

a hollow ballast-receiving base capable of assembly with said pole and with said backboard and said goal to form the portable basketball system wherein said base supports said pole in a stationary, substantially upward position and is connected to said pole near said base end of said pole and said goal is connected to said backboard which is connected to said pole near said backboard end of said pole so that said goal is suspended at an elevation above said base.

2. The basketball assemblage of claim 1, wherein said latch further comprises:

a bracket mounted to said outer pole section; and a pivot arm having an engagement edge, said pivot arm being pivotally mounted to said bracket for movement between an engaging position in which said engagement edge is positioned for engaging a selected one of said depressions for preventing telescoping movement of said inner pole section toward said base end, and a releasing position in which said engagement edge is positioned free of said depressions for allowing telescoping movement of said inner pole section toward said base end.

3. The basketball assemblage of claim 2, wherein said latch further comprises a biasing means urging said pivot arm toward said engaging position.

4. The basketball assemblage of claim 2, wherein said latch further comprises a safety lock pin releasably engageable with said bracket at a location adjacent said pivot arm for preventing movement of said pivot arm from said engaging position into said releasing position.

5. The basketball assemblage of claim 1, further comprising a slider positioned at one end of said outer pole section adjacent said inner pole section for reducing binding during telescoping movement of said inner pole section within said outer pole section against said slider.

6. The basketball assemblage of claim 1, wherein said base has an exterior contour for receiving and retaining said pole sections within the container and impeding shifting movement of said pole sections within the container during shipping, the exterior contour of said base comprising at least one notch for receiving and retaining at least one of said pole sections within the container.

7. The basketball assemblage of claim 1, wherein said pole further comprises:

a base seal disposed for substantially sealing said base end of said pole; and a traveling seal secured to said inner pole section, said traveling seal positioned between said inner pole section and said outer pole section for damping movement of said inner pole section toward said base end by compressing air within said pole between said traveling seal and said base seal.

8. The basketball assemblage of claim 7, further comprising a valve secured to said pole, said valve configured to release air slowly from within said pole in response to movement of said traveling seal toward said base seal, and said valve configured to permit air to more rapidly enter said pole in response to movement of said traveling seal away from said base seal.

9. The basketball assemblage of claim 8, wherein said valve secured to said pole is disposed within said traveling seal.

10. The basketball assemblage of claim 8, wherein said valve secured to said pole is disposed within said base seal.

11. The basketball assemblage of claim 8, wherein said valve secured to said pole is disposed within a selected one of said pole sections near said base end of said pole.

12. The basketball assemblage of claim 8, wherein said valve comprises a check ball valve.

13. The basketball assemblage of claim 1, further comprising a brace having a pole end and a base end, said brace connectable to said pole at said pole end of said brace near said base end of said pole, said brace connectable to said base at said base end of said brace, wherein said base, said pole, said brace, said backboard, and said goal are capable of assembly to form the portable basketball system wherein said brace is disposed on the opposite side of said pole from said goal for reducing the risk of a player accidentally encountering said brace during basketball play.

14. A basketball assemblage connectable to a backboard connected to a goal to form a portable basketball system, the basketball assemblage comprising:

a plurality of prolate pole sections including at least an inner pole section and an outer pole section, said inner pole section having an exterior surface containing a plurality of depressions, said plurality of prolate pole sections capable of assembly to form an prolate pole having a base end and a backboard end;

a hollow ballast-receiving base capable of assembly with said prolate pole and with the backboard and the goal to form the portable basketball system wherein said base supports said prolate pole in a stationary, substantially upward position and is connected to said prolate pole near said base end of said prolate pole and the backboard is connected to said prolate pole near said backboard end of said prolate pole so that the goal is suspended at an elevation above said base; and a latch secured to said outer pole section and configured to releasably engage said depressions in said exterior surface of said inner pole section, said prolate pole movable among a plurality of predetermined positions by telescoping movement of said inner pole section within said outer pole section and said prolate pole fixable at a predetermined length by engagement of a selected one of said depressions by said latch.

15. The basketball assemblage of claim 14, wherein said latch comprises:

a bracket mounted to said outer pole section; and a pivot arm having an engagement edge, said pivot arm pivotally mounted to said bracket for movement between an engaging position in which said engagement edge is positioned for engaging a selected one of said depressions for preventing telescoping movement of said inner pole section toward said base end, and a releasing position in which said engagement edge is positioned free of said depressions for allowing telescoping movement of said inner pole section toward said base end.

16. The basketball assemblage of claim 15, wherein said latch further comprises a biasing means urging said pivot arm toward said engaging position.

17. The basketball assemblage of claim 15, wherein said latch further comprises a safety lock pin releasably engageable with said bracket at a location adjacent said pivot arm for preventing movement of said pivot arm from said engaging position into said releasing position.

18. The basketball assemblage of claim 14, further comprising a slider positioned at one end of said outer pole section adjacent said inner pole section for reducing binding during telescoping movement of said inner pole section within said outer pole section against said slider.

19. The basketball assemblage of claim 18, further comprising a latch cover integrally secured to said slider, said latch covering at least a portion of said latch for cushioning impact of a basketball against said latch.

20. The basketball assemblage of claim 14, wherein said base has an exterior contour for receiving and retaining said prolate pole sections within the container and impeding shifting movement of said prolate pole sections within the container during shipping, the exterior contour of said base comprising at least one notch for receiving and retaining at least one of said prolate pole sections within the container.

21. The basketball assemblage of claim 14, wherein said prolate pole further comprises:

a base seal secured to said prolate pole for substantially sealing said base end of said prolate pole; and a traveling seal secured to said inner pole section, said traveling seal positioned between said inner pole section and said outer pole section for damping movement of said inner pole section toward said base end by compressing air within said prolate pole between said traveling seal and said base seal.

22. The basketball assemblage of claim 21, further comprising a valve secured to said prolate pole, said valve configured to release air slowly from within said prolate pole in response to movement of said traveling seal toward said base seal, and said valve configured to permit air to more rapidly enter said prolate pole in response to movement of said traveling seal away from said base seal.

23. The basketball assemblage of claim 22, wherein said valve comprises a check ball valve.

24. The basketball assemblage of claim 14, further comprising a brace having a pole end and a base end, said brace connectable to said prolate pole at said pole end of said brace near said base end of said prolate pole, said brace connectable to said base at said base end of said brace, wherein said base, said prolate pole, said brace, the backboard, and the goal are capable of assembly to form the portable basketball system wherein said brace is disposed on the opposite side of said prolate pole from the goal for reducing the risk of a player accidentally encountering said brace during basketball play.

25. A basketball assemblage connectable to a backboard connected to a goal to form a basketball system, the basketball assemblage comprising:

a plurality of pole sections including at least an inner pole section and an outer pole section, said plurality of pole sections capable of assembly to form a pole having a base end and a backboard end;

a base seal disposed for substantially sealing said base end of said pole; and a traveling seal secured to said inner pole section, said traveling seal positioned between said inner pole section and said outer pole section for damping movement of said inner pole section toward said base end by compressing air within said pole between said traveling seal and said base seal.

26. The basketball assemblage of claim 25, further comprising a valve secured to said pole, said valve configured to release air slowly from within said pole in response to movement of said traveling seal toward said base seal, and said valve configured to permit air to more rapidly enter said pole in response to movement of said traveling seal away from said base seal.

27. The basketball assemblage of claim 26, wherein said valve comprises a check ball valve.

28. The basketball assemblage of claim 25, wherein the basketball assemblage is connectable to a backboard connected to a goal to form a portable basketball system, the basketball assemblage further comprising a hollow ballast-receiving base capable of assembly with said pole and with the backboard and the goal to form the portable basketball system wherein said base supports said pole in a stationary, substantially upward position and is connected to said pole near said base end of said pole and the backboard is connected to said pole near said backboard end of said pole so that the goal is suspended at an elevation above said base.

29. The basketball assemblage of claim 28, wherein said base has an exterior contour for receiving and retaining said pole sections within the container and impeding shifting movement of said pole sections within the container during shipping, the exterior contour of said base comprising at least one notch for receiving and retaining at least one of said pole sections within the container.

30. The basketball assemblage of claim 28, further comprising a brace having a pole end and a base end, said brace connectable to said pole at said pole end of said brace near said base end of said pole, said brace connectable to said base at said base end of said brace, wherein said base, said pole, said brace, the backboard, and the goal are capable of assembly to form the portable basketball system wherein said brace is disposed on the opposite side of said pole from the goal for reducing the risk of a player accidentally encountering said brace during basketball play.

31. The basketball assemblage of claim 25, wherein said inner pole section has an exterior surface containing a plurality of depressions, said basketball assemblage further comprising a latch secured to said outer pole section, said latch configured to releasably engage said depressions in said exterior surface of said inner pole section, said pole movable among a plurality of predetermined positions by telescoping movement of said inner pole section within said outer pole section and said pole fixable at a predetermined length by engagement of a selected one of said depressions by said latch.

32. The basketball assemblage of claim 31, wherein said latch comprises:

a bracket mounted to said outer pole section; and a pivot arm having an engagement edge, said pivot arm pivotally mounted to said bracket for movement between an engaging position in which said engagement edge is positioned for engaging a selected one of said depressions for preventing telescoping movement of said inner pole section toward said base end, and a releasing position in which said engagement edge is positioned free of said depressions for allowing telescoping movement of said inner pole section toward said base end.

33. The basketball assemblage of claim 32, wherein said latch further comprises a biasing means urging said pivot arm toward said engaging position.

34. The basketball assemblage of claim 32, wherein said latch further comprises a safety lock pin releasably engageable with said bracket at a location adjacent said pivot arm for preventing movement of said pivot arm from said engaging position into said releasing position.

35. The basketball assemblage of claim 25, further comprising a slider positioned at one end of said outer pole section adjacent said inner pole section for reducing binding during telescoping movement of said inner pole section within said outer pole section against said slider.

36. A basketball assemblage connectable to a backboard connected to a goal to form a portable basketball system, the basketball assemblage comprising:

a plurality of prolate pole sections including at least an inner pole section and an outer pole section, said inner pole section having an exterior surface containing a plurality of depressions, said plurality of prolate pole sections capable of assembly to form an prolate pole having a base end and a backboard end;

a slider positioned at one end of said outer pole section adjacent said inner pole section for reducing binding during telescoping movement of said inner pole section within said outer pole section against said slider;

a hollow ballast-receiving base capable of assembly with said prolate pole and with the backboard and the goal to form the portable basketball system wherein said base supports said prolate pole in a stationary, substantially upward position and is connected to said prolate pole near said base end of said prolate pole and the backboard is connected to said prolate pole near said backboard end of said prolate pole so that the goal is suspended at an elevation above said base; and a latch secured to said outer pole section and configured to releasably engage said depressions in said exterior surface of said inner pole section, said prolate pole movable among a plurality of predetermined positions by telescoping movement of said inner pole section within said outer pole section and said prolate pole fixable at a predetermined length by engagement of a selected one of said depressions by said latch, said latch comprising:

a bracket mounted to said outer pole section; and a pivot arm having an engagement edge, said pivot arm pivotally mounted to said bracket for movement between an engaging position in which said engagement edge is positioned for engaging a selected one of said depressions for preventing telescoping movement of said inner pole section toward said base end, and a releasing position in which said engagement edge is positioned free of said depressions for allowing telescoping movement of said inner pole section toward said base end; and a biasing means urging said pivot arm toward said engaging position.

37. The basketball assemblage of claim 36, wherein said latch further comprises a safety lock pin releasably engageable with said bracket at a location adjacent said pivot arm for preventing movement of said pivot arm from said engaging position into said releasing position.

38. The basketball assemblage of claim 36, further comprising a latch cover integrally secured to said slider, said latch covering at least a portion of said bracket and said pivot arm for cushioning impact of a basketball against said latch.

39. The basketball assemblage of claim 36, wherein said base has an exterior contour for receiving and retaining said prolate pole sections within the container and impeding shifting movement of said prolate pole sections within the container during shipping, the exterior contour of said base comprising at least one notch for receiving and retaining at least one of said prolate pole sections within the container.

40. The basketball assemblage of claim 36, wherein said prolate pole further comprises:

a base seal disposed for substantially sealing said base end of said pole; and a traveling seal secured to said inner pole section, said traveling seal positioned between said inner pole section and said outer pole section for damping movement of said inner pole section toward said base end by compressing air within said pole between said traveling seal and said base seal.

41. The basketball assemblage of claim 40, further comprising a check ball valve secured to said prolate pole, said check ball valve configured to release air slowly from within said prolate pole in response to movement of said traveling seal toward said base seal, and said check ball valve configured to permit air to more rapidly enter said prolate pole in response to movement of said traveling seal away from said base seal.

42. The basketball assemblage of claim 36, further comprising a brace having a pole end and a base end, said brace connectable to said prolate pole at said pole end of said brace near said base end of said prolate pole, said brace connectable to said base at said base end of said brace, wherein said base, said prolate pole, said brace, the backboard, and the goal are capable of assembly to form the portable basketball system wherein said brace is disposed on the opposite side of said prolate pole from the goal for reducing the risk of a player accidentally encountering said brace during basketball play.

* * * * *